United States Patent [19]

Feng

[11] Patent Number: 4,787,161

[45] Date of Patent: Nov. 29, 1988

[54] ADVERTISING WRITING INSTRUMENT

[76] Inventor: Ou-Yang Feng, P.O. Box 10160, Taipei, Taiwan

[21] Appl. No.: 73,229

[22] Filed: Jul. 13, 1987

[51] Int. Cl.[4] ..... G09F 19/06

[52] U.S. Cl. ..... 40/334; 40/358

[58] Field of Search ..... D19/81, 83, 84; 40/334, 40/335, 358; 15/435

[56] References Cited

U.S. PATENT DOCUMENTS

| | | | |
|---|---|---|---|
| D. 111,492 | 9/1938 | Hassenfeld | 19/84 |
| 164,548 | 9/1851 | Blish | 40/334 |
| 173,330 | 2/1876 | Park | 40/317 |
| D. 223,476 | 4/1972 | Longarzo | D19/84 |
| D. 231,138 | 4/1974 | Ewry | D19/84 |
| 696,957 | 4/1902 | Freeborn | 40/317 |
| 1,183,436 | 5/1916 | Conklin | 40/334 |
| 1,219,386 | 3/1917 | Fernandez | 40/317 |
| 1,230,761 | 6/1917 | Newman | 40/335 |
| 1,245,972 | 11/1917 | Roberts | 40/335 |
| 1,262,972 | 4/1918 | Olson | 40/324 |
| 1,263,327 | 4/1918 | Kristofek | 40/334 |
| 1,288,630 | 12/1918 | Lyons | 40/317 |
| 1,297,017 | 3/1919 | Scott | 40/334 |
| 1,412,938 | 4/1972 | Halket | 40/334 |
| 1,561,725 | 11/1925 | Kerley | 40/334 |
| 1,713,380 | 5/1929 | Green | 40/334 |
| 1,832,318 | 11/1931 | Myers | 40/334 |
| 2,111,362 | 3/1938 | Fisher | 40/335 |
| 2,248,145 | 7/1941 | Wilder | 46/334 |
| 2,620,143 | 12/1952 | Armelin | 40/334 |
| 3,846,927 | 11/1974 | Geffen | 40/334 |
| 3,961,852 | 6/1976 | Parry | 40/334 |
| 4,030,842 | 6/1977 | White et al. | 40/335 |

*Primary Examiner*—Paul J. Hirsh

[57] ABSTRACT

An advertising pen device includes a collapsible display sheet selected from a flag or a decorative or advertising cloth prewound on a pole rotatably mounted inside the pen and adapted to be extended for display or advertisement purpose, and a pen holder adapted for holding the pen to lay on a desk or for clamping the pen on a user's pocket for display, decorative or identification uses.

1 Claim, 2 Drawing Sheets

ADVERTISING WRITING INSTRUMENT

BACKGROUND OF THE INVENTION

Karl Yeranossian disclosed a display stand in his U.S. Pat. No. Des. 286,829 which may be used for display or advertising purpose, but can not serve for writing purpose and can not reduce its volume for the convenience of handling or storage.

It is therefore expected by the inventor to disclose a pen which can serve for writing and can also be extended for advertising display purposes to increase its multiple functions.

SUMMARY OF THE INVENTION

The object of the present invention is to provide a pen means including a pen having a collapsible display sheet reeled in a pen barrel, and a pen holder serving a supporting base for holding the pen on a desk, wherein the display sheet can be reeled off from the pen for display or ornamental purposes, and the pen holder having its one surface formed with a decorative figure and having the other surface of the older parallelly inserted wtih the pen to form a clip for clamping the holder on a user's pocket for ornamental or identifcation purposes.

BRIEF DESCRIPTION OF THE DRAWINGS

FIG . 1 is a perspective illustration of the present invention.

DETAILED DESCRIPTION

Figure 1:
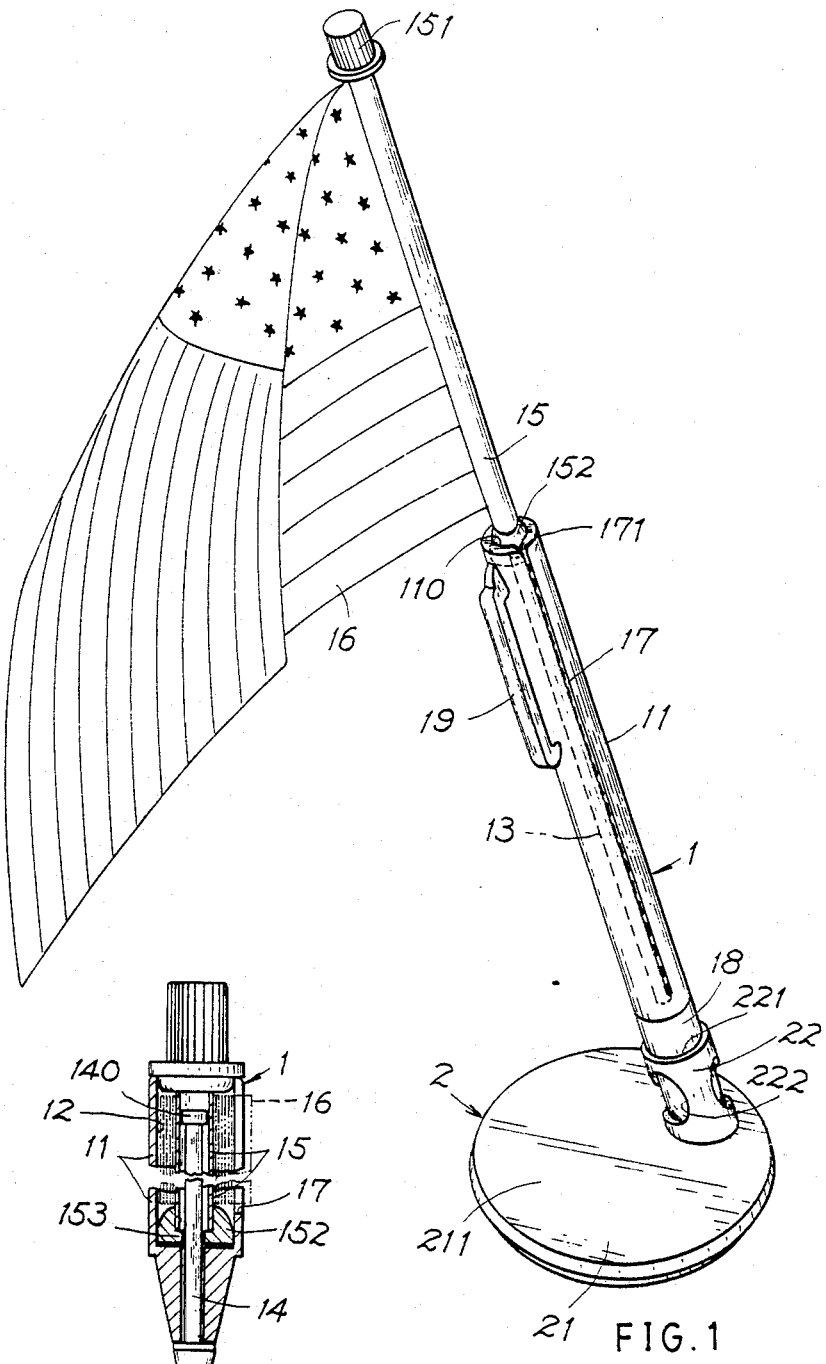

As shown in FIGS. 1–5, the present invention comprises: a pen 1 and a pen holder 2.

The pen 1 includes: a pen barrel 11 having a hollow cylindrical hole 12 formed on the upper portion of the barrel 11 and a lower tapered portion 11 formed on the lower portion of the barrel, an axle tube 13 fixed in the lower tapered portion 111 inside the barrel 11, a central stick 14 selected from a pencil lead of a pencil or an inner ink reservoir of a ball pen and replaceably mounted in the axle tube 13 to protrude its nib 141 outwardly for writing use, a reel pole 15 having an inner hole 150 rotatably mounted on the axle tube 13 and slidably reciprocated along the tube 13 inside the barrel 11, a display sheet 16 selected from a flag cloth, an advertising paper or other display clothes operatively wound on the reel pole 15 through a longitudinal slit 17 formed on the barrel 11 as cut from a top opening 110 of the barrel 11, a clip 19 is formed on the upper portion of the barrel 11 and a lower cap 18 covering the nib 141 of the pen.

Figure 6:
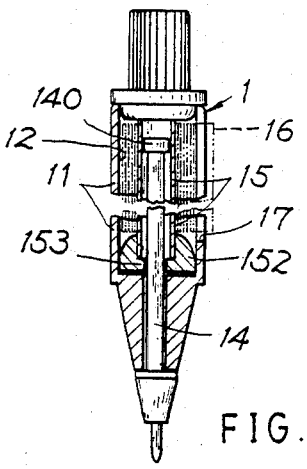
FIG. 6 shows another preferred embodiment of the present invention.
Figure 3:
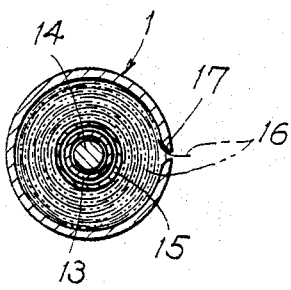
FIG. 3 is a cross-sectional drawing of the present invention.
Figure 2:
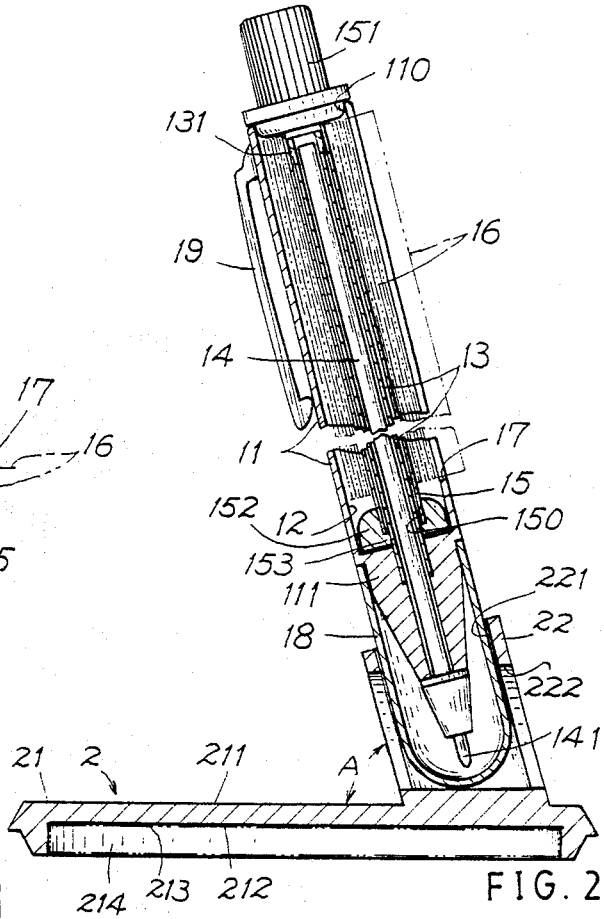
FIG. 2 is a sectional drawing of the present invention.

The uppermost end of the longitudinal slit 17 of the barrel 11 is formed as an expansion trumpet port 171 adapted for retracting the display sheet 16 (as shown in FIG. 1) into the barrel 11. The length of the slit 17 should be larger than the height of the display sheet 16 so that the extended sheet 16 can be operatively wound on the pole 15 through the slit 17. The materials of the display sheet 16 can be made of flexible clothes, plastics or papers having a suitable toughness so that once extending the pole 15 upwardly beyond the barrel 11 the sheet 16 may be quickly automatically unwound by its own toughness for display or ornamental purpose. The pole 15 is formed with a top knob 151 on its top end for rotating the pole for winding the sheet 16 on the pole or unwinding the sheet 16 from the pole 15, and formed with a lower plug 152 on its lower end so that once pulling the pole 15 outwardly from the barrel 11 the annular hook portion 153 formed inside the plug 152 will be limited against an upper extension 131 formed on the top end of the axle tube 13. The top knob 151 is operatively rotated on the top opening 110 of the barrel 11 while the lower plug 152 rotatably engaged with the bottom of the cylindrical hole 12 when retracting the pole 15 into the barrel 11 as shwon in FIG. 2. The length of the hole 12 is generally equal to the distance spaced between the knob 151 and the plug 152. Another preferred embodiment of the pen is shown in FIG. 6 in which the aforementioned axle tube 13 is omitted and the pole 15 is directly rotatably mounted on the central stick 14. The top end of the stick 14 is formed with an upper extension 140 for limiting the hook portion 153 of the pole plug 152 when extending the pole 15 upwardly.

Figure 5:
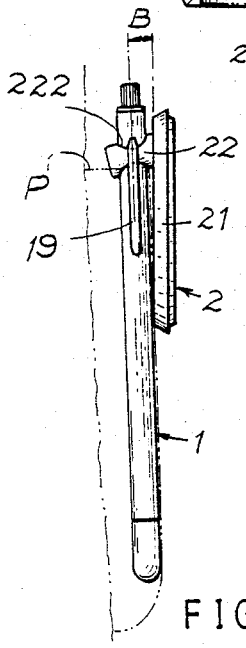
FIG. 5 is a side-view illustration of FIG. 4.
Figure 4:
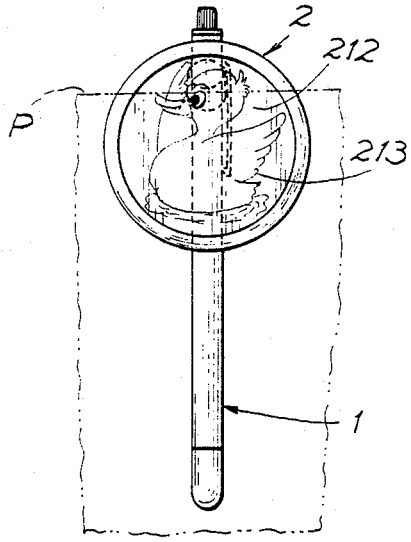
FIG. 4 is an illustration showing the present invention when clamped on a user's pocket.

The pen holder 2 includes a disk portion 21 having a first surface 211 and a second surface 212 formed on the reverse side of the first surface 211 and adhered thereon with a display figure 213 which is further covered by a transparent cover 214, and a jacket pipe 22 protruding on the first surface 211 of the disk portion 21 forming an acute angle A with the surface 211. The jacket pipe 22 is formed with a longitudinal socket 221 adapted for holding the pen 1 therein so that the disk 21 can be laid on a desk, and formed with a transverse through hole 222 intersecting the longitudinal socket 221 adapted for inserting the pen 1 through the hole 222 by engaging the clip 19 with the wall of pipe 22 so that the disk 21 as clipped by the pen 1 may be clamped on a user's pocket P as shown in FIGS. 4 and 5 to reveal the display figure 213 for advertising, ornamental or even security identification purposes. The pen 1 when inserted into the transverse hole 222 should form a small aperture between the pen and the disk 21 for tightly clamping on a pocket since the center line of the hole 222 is formed with a small angle B with the disk 21 as shown in FIG. 5.

Accordingly, the present invention has the following advantages superior to a conventional pen and display device:

1. The display sheet 16 is prewound inside the pen and can be extended outwardly beyond the barrel 11 ready for table display uses. When it is intended to retract the sheet 16 into the barrel 11, the pole 15 is rotated to aim the sheet 16 at the slit 17 and the flat sheet is then retracted downwardly into the barrel 11 and further reeled on the axle tube 13 to conceal the sheet inside the barrel as a compact unit.

2. The disk 21 as clipped with the pen 1 may be clamped on a user's pocket for advertising, ornamental or security identification purposes to diversify the functions of this invention.

I claim:

1. An advertising pen means comprising a pen having: a pen barrel having a hollow cylindrical hole formed in an upper portion of the barrel and a longitudinal slit formed in the barrel as downwardly notched from a top opening of said barrel, an axle tube fixed inside said barrel, a central stick selected from a pencil lead of a pencil or an inner ink reservoir of a ball pen replaceably mounted in said axle tube, a reel pole rotatably mounted on said axle tube and slidably reciprocated along the tube inside the barrel, a display sheet selected from a flag cloth, an advertising paper and a display cloth operatively wound on the reel pole through said longitudinal slit in said barrel, a clip formed on an upper portion of said barrel and a lower cap covering a nib of said pen;

said longitudinal slit having a length larger than a height of said display sheet;

said reel pole having a top knob formed on a top end of said pole rotatably engaged with a top opening of said barrel and having a lower plug formed on a lower end of said pole engageable with a bottom of said cylindrical hole of said barrel;

the improvement which comprises: said lower plug having an annular hook portion formed between said reel pole and said axle tube, and said axle tube having an extension formed on a top end of said tube, whereby upon an upward extending of said pole to protrude said display sheet beyond said barrel, said lower plug of said pole is limited by said extension of said tube; and said longitudinal slit having a trumpet port diverging upwardly and outwardly from a top opening of said slit, adapted for a retraction of said display sheet into said barrel through said port and said slit.

* * * * *